United States Patent [19]

Miller et al.

[11] 4,005,229

[45] Jan. 25, 1977

[54] NOVEL METHOD FOR THE RAPID DEPOSITION OF GOLD FILMS ONTO NON-METALLIC SUBSTRATES AT AMBIENT TEMPERATURES

[75] Inventors: Richard G. Miller, Pittsburgh; Roy L. Cavitt, New Kensington, both of Pa.

[73] Assignee: PPG Industries, Inc., Pittsburgh, Pa.

[22] Filed: June 23, 1975

[21] Appl. No.: 589,234

[52] U.S. Cl. ..... 427/304; 106/1; 427/168; 427/426

[51] Int. Cl.[2] ..... C23C 3/02

[58] Field of Search ..... 106/1; 427/304, 437, 427/168, 169

[56] References Cited

UNITED STATES PATENTS

| | | | |
|---|---|---|---|
| 2,929,742 | 3/1960 | DeMinjer et al. | 427/438 |
| 3,147,133 | 9/1964 | Loiseleur | 427/169 X |
| 3,192,137 | 6/1965 | Dippel et al. | 427/125 X |
| 3,300,328 | 1/1967 | Luce | 427/437 X |
| 3,515,571 | 6/1970 | Levy | 427/168 X |
| 3,589,916 | 6/1971 | McCormack | 427/437 |
| 3,649,308 | 3/1972 | Gulla et al. | 106/1 |
| 3,672,939 | 6/1972 | Miller | 427/168 |

FOREIGN PATENTS OR APPLICATIONS

| | | |
|---|---|---|
| 1,925,648 | 11/1970 | Germany |

*Primary Examiner*—Ralph S. Kendall
*Attorney, Agent, or Firm*—Donna L. Seidel; E. Kears Pollock

[57] ABSTRACT

Gold films are deposited on non-metallic substrates very rapidly at ambient temperatures by sensitizing and activating a surface of a non-metallic substrate to be coated and subsequently contacting the activated surface with a solution containing a gold salt which is reduced to a metallic gold film in the presence of divalent mercury, cadmium or lead ions.

31 Claims, No Drawings

NOVEL METHOD FOR THE RAPID DEPOSITION OF GOLD FILMS ONTO NON-METALLIC SUBSTRATES AT AMBIENT TEMPERATURES

BACKGROUND OF THE INVENTION

1. Field of the Invention

The present invention relates broadly to wet chemical methods of depositing gold films on non-metallic substrates. More particularly, this invention relates to a method for the rapid deposition of very thin uniform transparent gold films on transparent substrates, such as glass.

2. Description of the Prior Art

The art of formation of gold films on various surfaces has a long history. Ancient alchemists discovered methods for depositing gold by chemical reduction. Metals were particularly adaptable to being coated with gold films and many articles were decorated in this manner.

The excellent reflective properties of gold films were later utilized in the art of making gold mirrors, especially when it was discovered that gold films could be made to adhere to non-metallic substrates such as glass. However, the cost of gold has restricted the use of gold mirrors to very limited decorative purposes. The earlier history of gold films and the development of the art of depositing bright gold films on non-metallic substrates are discussed at length in a series of articles by Samuel Wein entitled "GOLD FILMS", appearing in *THE GLASS INDUSTRY*, a trade journal, in 1959. Major disadvantages encountered in the described methods were bulk precipitation of reduced gold metal and a very slow rate of deposition, requiring up to 24 hours of immersion of the article in the plating solution. Other references disclose methods for depositing gold films involving relatively complicated process steps or requiring elevated temperatures.

Aufsberg describes a method in German Patent No. 178,523 for effecting a cohesive, brightly reflecting gilding on a substrate such as glass by first providing the surface with a thin non-reflective film of silver or silver which contains some lead. Shortly before contacting the sensitized surface, the alkaline gilding solution, comprising a gold salt and sodium chloride, is mixed with small amounts of a strong reducing agent such as hydrogen peroxide, sodium peroxide, formaldehyde, ether, and so on, or with a mixture of these substances. This gilding process results in a bright, cohesive gold mirror. The method also teaches that for gilding a flat surface, such as a glass plate, a moldable gutta-percha rim should be provided to hold the solution in place, since it is necessary for the solution to remain in contact with the surface for a prolonged period.

A more recent development in the art of depositing gold films appears in U.S. Pat. No. 3,300,328 to Luce. The invention is described as an aqueous electroless gold plating bath comprising a gold compound, an ammonium or alkali metal sulphite or metabisulphite complexing agent, and a hydrazine or hydroxylamine reducing agent. Like the Aufsberg method previously described, the method of depositing a gold film taught by Luce involves first depositing a thin metal film in order to accomplish sensitization when a non-metallic substrate is employed. However, the strength of the reducing agents disclosed by Luce promotes deposition of a gold film at higher rates than had been previously encountered. While the Luce method for depositing gold films is relatively fast when compared with the Aufsberg method, requiring as little as 40 minutes, it has the disadvantage of requiring elevated temperature and agitation of the bath in order to maximize the rate of deposition.

Another more recent development in the art of depositing gold films is a method described in British Patent No. 1,257,995 to Albeck for gold-plating circuit substrates. This method uses sensitization and activation processes now considered standard in the electroless coating art, followed by a gold-plating process performed in a bath containing chloroauric acid, urea and citric acid. Suitable gold layers are deposited in only 30 to 60 minutes; however, this method also requires elevated temperatures in addition to cooling and filtering apparati. Nonetheless, this invention makes advantageous use of the electrical conductivity of gold films.

More recently, the heat-reflective character of gold films has commanded more attention than their electrical conductivity. Solar control properties have become increasingly important in coatings for glass used in architectural applications. Such coatings are expected to give aesthetically pleasing color results in addition to reflecting solar energy to aid in controlling the environment within the enclosed structure.

Recent advances in this field have been made with films of a variety of metals. Transparent metal films have been produced on transparent articles by a variety of techniques, including electroless or wet chemical techniques. These techniques generally involve contacting the article to be coated with solutions suitable for depositing a metal film thereon by reducing a metal salt from the solution. Typical of the successful methods are U.S. Pat. No. 3,671,291 to Miller and Cavitt for the deposition of nickel, iron and cobalt and U.S. Pat. No. 3,457,138 to Miller for the deposition of copper. For such techniques to be commercially practicable, it is necessary that they be relatively simple, rapid, and readily adaptable to the glass production line. Known techniques for the deposition of gold films are generally inadequate.

The previously described method of Luce is relatively simple. However, in addition to the fact that the method is too slow to be conveniently adaptable to continuous production line coating, the gold films deposited thereby are not transparent and therefore unsuitable for use in conjunction with glass substrates for architectural applications where an aesthetically pleasing uniform transparent article is required.

A sufficiently rapid method for the deposition of gold films is described by Levy in U.S. Pat. No. 3,515,571. According to this invention, gold films may be deposited on various metallic and non-metallic substrates by contacting a surface with a solution of a gold salt and a coordinating ligand and another solution containing a hydrazine compound as the reducing agent for gold. Suitable films can be deposited in less than one minute at room temperature. A useful property of gold films deposited by this method is their electrical conductivity, and Levy suggests their use as conductors, electrodes and contacts. An especially useful application of the method, taught by Levy, is the spraying of gold films on glass. Rapid deposition of specular films is taught for the production of high quality gold mirrors. However, specular films are not suitable for architectural applications wherein viewing through the coated article is a desired object.

The method of Kushihashi described in U.S. Pat. No. 3,484,263 provides a homogeneous coating on glass resulting in an article having high thermal reflectance. However, this method is not sufficiently simple to allow its adaptation to continuous, production-line coating because it requires exposure to radiation in order to promote the reduction of the gold salt to gold. In addition, the resultant gold films are semi-transparent and therefore unsuitable for many applications wherein a transparent article is required or desirable.

Finally, a method of depositing a transparent gold film is described by Soderberg in U.S. Pat. No. 3,476,594. After standard processes of sensitization and activation of the substrate are completed, a nickel film is deposited thereon by a conventional known technique. A gold film is then deposited over the nickel film, preferably from a solution containing potassium gold cyanide at an elevated temperature. Deposition of the gold film is followed by heat treatment to decrease the surface resistance and heat transmittance and increase the light transmittance. The resultant articles possess a combination of desirable properties. The nickel film imparts a neutral color to transmitted light while the gold film renders the article electrically conductive and heat-reflective. While the final product has desirable properties, the multi-step process is undesirable when adaptation to continuous production-line coating is considered.

The present invention provides a fast, simple, and commercially-practicable method of depositing uniform, transparent gold films onto glass to provide aesthetically pleasing transparent articles having excellent solar energy control properties.

SUMMARY OF THE INVENTION

Transparent gold films are deposited on transparent substrates in the production of aesthetically pleasing transparent articles having high heat reflectance. The rate of deposition is sufficiently high to permit the method of this invention to be adapted to continuous, high-speed production lines. The substrate to be coated is first sensitized, then activated. The gold film is deposited by contacting the treated surface of the substrate substantially simultaneously with a gold solution and a reducing solution in the presence of divalent ions of mercury, cadmium or lead.

The gold solution comprises water, a gold compound and a complexing agent. Such gold compounds as the chloride, bromide, iodide, nitrate, sulfate, and acetate salts, as well as the acidic and basic salts of gold may be employed in the solution. Suitable complexing agents include alkali metal hydroxides and alkali metal carbonates. The gold solution is aged for several hours prior to use and is ready for deposition of a film when bulk precipitation of the solution no longer occurs instantaneously when reducing solution is added. For production line coating, it is desirable that the gold solution be aged until bulk precipitation begins only after the gold solution and reducing solution have been in contact with each other for about a minute or more.

The reducing solution comprises water and a reducing agent for gold. Hydroxylamines, hydrazine or hydrazine derivatives are suitable reducing agents. The reducing solution may also contain a small amount of an anionic or non-ionic surfactant which enhances the uniformity of the gold film.

Contacting the activated surface of the substrate with the gold and reducing solutions in the presence of divalent mercury, cadmium, or lead ions may be accomplished either by contacting the activated surface with a separate solution of a divalent mercury, cadmium or lead salt prior to or simultaneously with the gold and reducing solutions or by adding divalent mercury, cadmium, or lead ions to either the gold solution or the reducing solution.

Gold films of desirable thicknesses are deposited at ambient temperatures in a few minutes or less. The resultant coated articles appear gold in reflectance from either surface and blue to blue-green in transmittance.

DESCRIPTION OF THE PREFERRED EMBODIMENTS

Large sheets or plates of glass are coated according to the method of this invention for use as windows.

Sheets of soda-lime-silica glass measuring about 4 by 6 feet (1.2 by 2 meters) and having a thickness of about 7/32 inch (0.56 cm.) are prepared for coating. First the surface to be coated is cleaned. The preferred method of cleaning is a blocking operation carried out with rotating felt blocks which gently abrade the surface with an aqueous slurry of a commercial cleaning compound. A continuous line apparatus for washing, rinsing and sweeping the surface is shown in U.S. Pat. No. 3,723,158 to Miller and Cavitt. Such apparatus may be effectively employed in the practice of this invention.

After cleaning, the surface of the sheet is contacted with a dilute solution of a sensitizing agent such as a tin salt and preferably stannous chloride. After a brief period of contact under ambient conditions, the sheet is rinsed, preferably with a relatively pure water such as deionized or demineralized water.

The glass sheet is then activated. Activation may be accomplished by contacting the sensitized surface with a dilute solution of palladium chloride. Alternatively, the sensitized surface may be activated by coating with a thin catalytic metal film, preferably a silver film of sufficient thickness to lower the luminous transmittance of the sheet to from about 60 percent to as low as 26 or 27 percent. Denser silver films, with luminous transmittance of about 24 percent of less, may be coated with gold according to the method of the present invention. However, the coated sheet will appear gold from the coated side and silver from the uncoated side. Suitable films may be deposited by contacting a sheet substantially simultaneously with a silvering solution and a reducing solution. The silvering solution preferably contains a silver salt, pH control agent, and complexing agent in relative proportions of about 1:1:3 parts by weight respectively. The silvering solution preferably contains from about 0.15 to about 15 grams of silver nitrate per liter, up to about 15 grams of sodium hydroxide per liter and from about 0.45 to about 60 milliliters of 28 to 30 percent aqueous ammonium hydroxide per liter. The balance of the solution is water. The reducing solution comprises essentially water and from about 0.5 to about 10 grams per liter of a reducing agent. Most common reducing agents are operative, dextrose being preferred.

After the sensitized surface has been activated, the surface of the substrate is rinsed thoroughly, preferably with demineralized water. The silver film may then be treated with a solution of a divalent mercury, cadmium or lead salt. The preferred method of treatment with the divalent metal salt, however, is to add the salt to the reducing solution in the subsequent gold deposition step as described below.

The gold film is deposited on the surface of the substrate by contacting the surface substantially simultaneously with a gold solution and a reducing solution, preferably in the presence of a surfactant to enhance the uniformity of the gold film. The preferred surfactant is linear dodecyl benzene sodium sulfonate, sold as Richonate 60B, by the Richardson Chemical Company or as Calsoft L-60 by the Pilot Chemical Company, with an optimum concentration range of about 0.005 to about 0.015 gram of surfactant per liter in the reducing solution. The preferred method of applying the solutions to the surface is by means of a double-nozzled spray gun. The gold solution comprises water, a gold salt and a complexing agent; preferably $AuCl_3$ in a range of about 1.0 to about 6.0 grams per liter, and sodium carbonate in a range of about 6 to about 36 grams per liter. The water used to make up the solution should be a relatively pure water, such as demineralized or deionized water. A fresh gold solution is likely to encounter bulk precipitation immediately upon contact with the reducing solution, therefore the solution is aged. Upon aging the gold solution fades from a bright yellow to almost colorless, indicating the minimum sufficient aging period. The optimum aging period depends on the deposition technique. For production line coating of large substrates, longer aging periods are required to prevent too rapid deposition, which results in a less uniform film. Proper aging of the gold solution may be determined by placing a few milliliters of the gold solution in a test tube and adding approximately the same volume of reducing solution. Bulk precipitation is instantaneous for a fresh gold solution. Precipitation after about 1 minute indicates that the gold solution has been aged for a sufficient period to allow production line coating at a deposition rate favorable to film uniformity.

Prior to contacting the surface of the substrate, the gold solution may be treated with divalent metal ions from a mercury, cadmium or lead salt. The preferred treatment comprises 5–20 parts per million of a divalent lead compound. Lead nitrate is the preferred source of divalent lead ions and should be added at levels of about 5 to 10 parts per million for gold solutions aged for less than 12 hours and about 15 to 20 parts per million for gold solutions aged for more than 12 hours. A more preferred method of treatment, however, is to have the divalent ions present in the reducing solution.

The gold solution is applied to the activated surface of the substrate at substantially the same time as the reducing solution. The reducing solution comprises water, a reducing agent for gold, and preferably the divalent mercury, cadmium or lead salt. The reducing agent is preferably hydrazine tartrate in a concentration range of from about 1.0 to about 5.0 grams per liter and, more preferably, from about 1.5 to about 2.0 grams per liter. The divalent salt is preferably lead nitrate in a concentration range of from 5 to 20 milligrams per liter.

While the deposition rate of the gold solution reaches a maximum after a relatively short period of aging, after which the rate begins to slowly decrease, the solution will plate satisfactorily after as long as 6 months.

Transparent gold films having a luminous transmittance as low as 15 percent may be deposited at ambient temperature in 1 minute or less.

The present invention will be further understood from the description of specific examples which follow.

EXAMPLE I

Glass sheets are cleaned, rinsed thoroughly with demineralized water, and sensitized with a dilute aqueous solution of stannous chloride. After again thoroughly rinsing the glass sheet with demineralized water, a very thin silver film is deposited in the following manner.

A silver solution containing about 0.5 gram per liter silver nitrate, 0.5 gram per liter sodium hydroxide and 1.5 milliliters per liter of 28 to 30 percent aqueous ammonium hydroxide and a reducing solution containing about 1.0 gram per liter dextrose are sprayed onto the glass through a double-nozzled spray gun. The silver film is then thoroughly rinsed with demineralized water.

A gold film is deposited in the same manner as the silver film. A gold solution is prepared by dissolving 2 grams of gold chloride in several hundred milliliters of demineralized water and diluting the final solution to 1 liter. The solution is then aged for a sufficient time to allow deposition at a favorable rate. The gold solution is then applied to the surface to be coated substantially simultaneously with the reducing solution comprising 2.0 grams of hydrazine tartrate, 5 milligrams of lead nitrate, and 0.01 gram of linear dodecyl benzene sodium sulfonate per liter of demineralized water.

Gold films having luminous transmittance of 25 to 30 percent are deposited in about 30 to 40 seconds. Films having luminous transmittance of 15 to 20 percent are deposited in about 60 seconds on a 1 square foot plate. The coated sheets are gold colored in reflectance from both surfaces and blue to blue-green by transmittance.

EXAMPLE II

Glass sheets are cleaned and sensitized as in Example I. Activation is carried out by contacting the sensitized surface with a dilute solution of palladium chloride. After these steps, the activated surface is contacted substantially simultaneously with a gold solution comprising 2.0 grams of gold chloride and 12 grams of sodium hydroxide per liter of water, and a reducing solution comprising, per liter of water, 2.0 grams of hydrazine tartrate, 10 milligrams of lead nitrate and 0.07 grams of Richonate 60B, a commercial surfactant from the Richardson Chemical Company. Gold films are produced as in Example I.

EXAMPLE III

Glass sheets are cleaned, sensitized and activated as in Example I. The surface to be coated is then contacted substantially simultaneously with a gold solution comprising 1.0 gram of gold chloride and 6.0 grams of potassium carbonate per liter of water and a reducing solution comprising, per liter of water, 1.0 gram of hydrazine tartrate, 15 parts per million divalent lead ion and 0.072 gram of Calsoft L-60, commercial surfactant from the Pilot Chemical Company. Gold films are produced as in Examples I and II.

The specific examples set forth above have been offered as illustrating, but not limiting, the present invention, which includes all variations and modifications thereof falling within the scope of the claims.

We claim:

1. In a method of preparing gold films on non-metallic substrates comprising the steps of sensitizing and activating a surface of the substrate and then contacting the activated surface with an aqueous solution of a gold salt and a complexing agent in the presence of a hydrazine or hydroxylamine reducing agent, the improvement which comprises aging the gold solution until it has faded from bright yellow to almost colorless prior to the step of contacting the activated surface of the substrate and carrying out said contacting step in the presence of divalent mercury, cadmium, lead or a mixture of such divalent ions.

2. The method according to claim 1 wherein the step of contacting the activated surface of the substrate with the gold solution and reducing solution in the presence of divalent mercury, cadmium, lead or a mixture of such divalent ions is accomplished by contacting the activated surface with an aqueous solution of a divalent mercury, cadmium, or lead salt or a mixture of such salts and then contacting the unrinsed activated surface with the gold solution and reducing solution.

3. The method according to claim 1 wherein the step of contacting the activated surface of the substrate with the gold solution and reducing solution in the presence of divalent mercury, cadmium, lead or a mixture of such divalent ions is accomplished by dissolving a divalent mercury, cadmium or lead salt or a mixture of such salts in the gold solution after aging.

4. The method according to claim 1 wherein the step of contacting the activated surface of the substrate with the gold solution and reducing the solution in the presence of divalent mercury, cadmium, lead or a mixture of such divalent ions is accomplished by dissolving a divalent mercury, cadmium or lead salt or a mixture of such salts in the reducing solution.

5. The method according to claim 4 wherein the activated surface is contacted with the gold solution and reducing solution in the presence of a divalent lead ions.

6. The method according to claim 5 wherein the reducing solution contains from about 3.5 to about 15.5 parts per million of divalent lead ions.

7. The method according to claim 1 wherein the gold solution is further aged for a sufficient period such that when the gold solution and reducing solution are mixed together, precipitation of gold from the combined solutions begins about one minute or more after the solutions are mixed together.

8. The method according to claim 7 wherein the step of contacting the activated surface of the substrate with the gold solution and reducing solution in the presence of divalent mercury, cadmium, lead or a mixture of such divalent ions is accomplished by first contacting the activated surface with an aqueous solution of a divalent mercury, cadmium or lead salt or a mixture of such salts and then contacting the unrinsed, activated surface with the gold solution and the reducing solution.

9. The method according to claim 7 wherein the step of contacting the activated surface of the substrate with the gold solution and reducing solution in the presence of divalent mercury, cadmium, lead or a mixture of such divalent ions is accomplished by dissolving a divalent mercury, cadmium or lead salt or a mixture of such salts in the gold solution after aging.

10. The method according to claim 7 wherein the step of contacting the activated surface of the substrate with the gold solution and reducing solution in the presence of divalent mercury, cadmium, lead or a mixture of such divalent ions is accomplished by dissolving a divalent mercury, cadmium or lead salt or a mixture of such salts in the reducing solution.

11. The method according to claim 10 wherein the divalent salt is a divalent lead salt.

12. The method according to claim 11 wherein the divalent lead salt is lead nitrate.

13. The method according to claim 12 wherein the concentration of lead nitrate in the reducing solution is from about 0.005 to about 0.020 grams per liter.

14. A method of depositing a gold film onto a glass substrate comprising the steps of:

a. sensitizing a surface of the substrate;

b. activating the sensitized surface;

c. preparing a first aqueous solution comprising a gold salt and a complexing agent for the gold salt and a second aqueous solution of a reducing agent selected from the group consisting of hydrazine, hydroxylamine and alkyl derivatives of hydrazine and hydroxylamine;

d. aging the first solution for a sufficient period such that when the two solutions are mixed together precipitation of gold from the combined solutions begins about one minute or more after the solutions are mixed together; and e. contacting the activated surface substantially simultaneously with the two solutions in the presence of divalent mercury, cadmium, lead or a mixture of such divalent ions.

15. The method according to claim 14 wherein the step of contacting the activated surface of the substrate with the gold solution and reducing solution in the presence of divalent mercury, cadmium, lead or a mixture of such divalent ions is accomplished by contacting the activated surface with an aqueous solution of a divalent mercury, cadmium, or lead salt or a mixture of such salts and then contacting the unrinsed activated surface with the gold solution and reducing solution.

16. The method according to claim 14 wherein the step of contacting the activated surface of the substrate with the gold solution and reducing solution in the presence of divalent mercury, cadmium, lead or a mixture of such divalent ions is accomplished by dissolving a divalent mercury, cadmium or lead salt or a mixture of such salts in the gold solution after aging.

17. The method according to claim 14 wherein the step of contacting the activated surface of the substrate with the gold solution and reducing solution in the presence of divalent mercury, cadmium, lead or a mixture of such divalent ions is accomplished by dissolving a divalent mercury, cadmium or lead salt or a mixture of such salts in the reducing solution.

18. The method according to claim 17 wherein the divalent salt is lead nitrate.

19. The method according to claim 18 wherein the reducing solution contains from about 0.005 to about 0.020 grams per liter of lead nitrate.

20. The method according to claim 14 wherein the step of activating the sensitized surface of the substrate is accomplished by contacting the sensitized surface with a solution of a palladium salt.

21. The method according to claim 20 wherein the step of contacting the activated surface is carried out with the first solution comprising a gold salt and an alkali metal hydroxide.

22. The method according to claim 14 wherein the step of activating the sensitized surface is accomplished by depositing a thin metal film thereon.

23. The method according to claim 22 wherein the thin metal film is a transparent silver film.

24. The method according to claim 23 wherein the step of contacting the activated surface is carried out with the first solution comprising a gold salt and an alkali metal carbonate.

25. The method according to claim 24 wherein the step of contacting the activated surface is carried out with a solution comprising gold chloride and sodium carbonate in the presence of hydrazine tartrate reducing agent.

26. The method according to claim 25 wherein the activated surface is contacted with the gold solution and reducing solution in the presence of divalent mercury, cadmium, lead or a mixture of such divalent ions and further in the presence of a non-ionic or anionic surfactant.

27. The method according to claim 26 wherein the surfactant is linear dodecyl benzene sodium sulfonate.

28. The method according to claim 27 wherein the surfactant is present in the reducing solution.

29. The method according to claim 28 wherein the concentration of surfactant in the reducing solution is from about 5 to about 15 milligrams per liter.

30. The method according to claim 25 wherein the activated surface is contacted substantially simultaneously with the following:

a. a gold solution comprising:
   1. about 1 to about 6 grams of gold chloride;
   2. about 6 to about 36 grams of sodium carbonate; and
   3. 1 liter of water; and b. a reducing solution comprising:
   1. about 1 to about 6 grams hydrazine tartrate;
   2. about 5 to about 20 milligrams of lead nitrate; and
   3. 1 liter of water.

31. The method according to claim 30 wherein the activated surface is maintained in contact with the gold and reducing solutions at ambient temperatures for a period of from about 10 seconds to about 5 minutes.

* * * * *